US006239503B1

(12) United States Patent
Ikeda et al.

(10) Patent No.: US 6,239,503 B1
(45) Date of Patent: May 29, 2001

(54) ELECTRIC STARTER MOTOR

(75) Inventors: Hirohide Ikeda; Keiichi Kusumoto; Kyoichi Okamoto, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/418,835

(22) Filed: Oct. 15, 1999

(30) Foreign Application Priority Data

May 12, 1999 (JP) ..... 11-131482

(51) Int. Cl.[7] ..... F02N 11/00

(52) U.S. Cl. ..... 290/38 R; 310/83; 74/7 E

(58) Field of Search ..... 290/38 R; 384/279, 384/910; 74/7 E, 7 C; 464/42, 10, 30, 160; 475/263, 265; 310/83

(56) References Cited

U.S. PATENT DOCUMENTS

| | | | | |
|---|---|---|---|---|
| 3,744,274 | * | 7/1973 | Sekiya et al. | 464/160 |
| 4,192,195 | * | 3/1980 | Kazino et al. | 74/7 A |
| 4,590,811 | | 5/1986 | Kasubuchi | 74/7 E |
| 5,199,309 | * | 4/1993 | Isozumi | 74/7 E |
| 5,323,663 | * | 6/1994 | Ohgi et al. | 74/7 E |
| 5,857,380 | * | 1/1999 | Kajino et al. | 74/7 E |
| 6,076,413 | * | 6/2000 | Verot et al. | 74/7 E |
| 6,086,257 | * | 7/2000 | Lee | 384/279 |

FOREIGN PATENT DOCUMENTS

| | | | |
|---|---|---|---|
| 0369867A1 | * | 5/1990 | (EP) . |
| 0529456A1 | * | 3/1993 | (EP) . |
| 649 984 | | 4/1995 | (EP) . |
| 1-141371 | | 9/1989 | (JP) . |
| 2-28576 | | 2/1990 | (JP) . |
| 10-28351 | | 1/1998 | (JP) . |

* cited by examiner

*Primary Examiner*—Joseph Waks
(74) *Attorney, Agent, or Firm*—Sughrue, Mion, Zinn, Macpeak & Seas, PLLC

(57) ABSTRACT

In an electric starter motor, a planetary reduction assembly includes: a sun gear engraved in an outer circumferential portion on a front side of a motor output shaft formed integrally with the armature; a ring formed into a cylindrical shape with a rotation stop projecting on an outer circumferential wall surface thereof and coupled to a front bracket while its movement in the circumferential direction is restricted by the rotation stop; an internal gear formed into a bottomed cylindrical shape with a center hole formed in a central portion of a bottom thereof and an inner circumferential gear portion engraved in an inner circumferential wall surface thereof, the internal gear being fitted in the ring so as to open on a rear side; a discoid flange portion formed integrally with an end portion on the rear side of the starter output shaft, supported rotatably to the bottom of the internal gear through a bearing and rotatably supporting an end portion on the front side of the motor output shaft through a bearing; and a plurality of planetary gears rotatably supported to a plurality of pins implanted concentrically at an equiangular pitch on an end face on the rear side of the flange portion, respectively, and engaging with the inner circumferential gear portion and the sun gear, and wherein the internal gear is fitted in the ring so as to slidingly rotate relative to the ring when a rotational torque to be applied to the starter output shaft exceeds a predetermined transmission rotational torque.

7 Claims, 4 Drawing Sheets

ELECTRIC STARTER MOTOR

BACKGROUND OF THE INVENTION

1. Field of the Invention

This invention relates to an electric starter motor provided with a planetary reduction assembly for reducing an rpm of a motor output shaft formed integrally with an armature to transmit to a starter output shaft, and more particularly to a shock absorber mechanism for an electric starter motor for absorbing a shock stress caused by an excessive rotational torque on a loaded side.

2. Description of the Related Art

FIG. 4 is a partial cross-sectional view showing a conventional electric starter motor incorporating a planetary speed reduction device, and FIG. 5 is a frontal view showing a primary part showing a coupled condition of an internal gear of the planetary reduction assembly in this conventional electric starter motor.

In FIGS. 4 and 5, the electric starter motor is composed of a starter motor 3 for generating a rotational torque, a planetary reduction assembly 5 for reducing and outputting an rpm of a motor output shaft 4 of this starter motor 3, an overrunning clutch 7 engaging with a starter output shaft 6 of this planetary reduction assembly 5, a pinion 8 integrated with the overrunning clutch 7 and slidably disposed on the starter output shaft 6, an electromagnetic switch 9 for controlling an electric supply to the starter motor 3 and for pushing the pinion 8 together with the overrunning clutch 7 towards a ring gear 14 of an engine by means of a shift lever 10, and the like.

The starter motor 3 is composed of a yoke 11 formed into a cylindrical shape having a bottom portion also functioning as an outer frame and a magnetic circuit, a field coil 12 wound around this yoke 11, an armature 13 disposed within this field coil 12, a rectifier (not shown) mounted on the motor output shaft 4, which is a rotary shaft of the armature 13, a brush (not shown) disposed in sliding contact with this rectifier, and the like. Then, a rear bracket 2 is fitted around an outer circumference of a rear end of the yoke 11 and joined to the yoke 11 to thereby support the rear end of the motor rotary shaft 4. Also, a front bracket 1 is fitted around an outer circumference of a front end of the yoke 11 and joined to the yoke 11.

The planetary reduction assembly 5 is composed of a sun gear 15 formed around an outer circumference of a front end of the motor rotary shaft 4, a plurality of planetary gears 16 meshing with this sun gear 15 and an internal gear 17 meshing with each of the planetary gears 16.

In the internal gear 17, a center hole is formed in a central portion of its bottom portion, a rotation stop 19 is formed on an outer circumferential wall surface, and an inner circumferential gear portion 18 is formed into a bottomed cylinder engraved in the inner circumferential wall surface. Then, the internal gear 17 is fitted in the front bracket 1 so as to open on the rear side (on the side of the armature). At this time, the rotation stop 19 is engaged with the front bracket 1 so that the movement of the internal gear 17 in the circumferential direction is restricted.

A discoid flange portion 20 is formed integrally with a rear end of the starter output shaft 6. Then, a plurality of pins 21 are implanted concentrically at an equiangular pitch on the rear end surface of the flange portion 20. The planetary gears 16 are supported rotatably to the respective pins 21. This flange portion 20, i.e., the starter output shaft 6 is rotatably supported through a bearing 22 fitted in the center hole of the internal gear 17 fixed to the front bracket 1 so that the front end portion of the motor output shaft 4 is rotatably supported through a bearing 23 fitted in the flange portion 20. Thus, the plurality of planetary gears 16 mesh with the sun gear 15 and the inner circumferential gear portion 18 to thereby constitute a planetary reduction mechanism.

The sun gear 15 rotates together with the motor rotary shaft 4 to transmit the rotation of the motor rotary shaft 4 to each planetary gear 16. Then, each planetary gear 16 is subjected to the rotation of the sun gear 15 to revolve around the outer circumference of the sun gear 15 while rotating on its axis. The starter output shaft 6 is drivingly rotated by the revolution of the planetary gears 16.

The overrunning clutch 7 is mounted on the starter output shaft 6 so as to be able to move in the axial direction and such that the rotational motion is transmitted thereto. That is, the overrunning clutch 7 is spline-fitted onto the starter output shaft 6. The pinion 8 is joined to a front end portion of a sleeve shaft 24 which constitutes the overrunning clutch 7. The shift lever 10 is mounted rotatably about a pivot portion 10*a* in it s inter mediate portion with its one end being engaged with the overrunning dutch 7 and the other end being coupled to a plunger (not shown) of the electromagnetic switch 9 mounted above the starter motor 3.

The operation of the thus constructed conventional electric starter motor will now be described.

First of all, before the operation of the starter motor assembly, the shift lever 10 is located in the position shown in FIG. 4, the overrunning clutch 7 has not yet been moved and the pinion 8 is not engaged with the ring gear 14.

Under this condition, when the key switch (not shown) is closed and the electric starter motor is operated, the armature 13 is electrically biased by the electric supply from the electromagnetic switch 9 and is rotated with the biasing force of the field coil 12. The motor output shaft 4 formed integrally with the armature 13 is drivingly rotated in accordance with the rotation of the armature 13. Also, the shift lever 10 is driven by the plunger within the electromagnetic switch 9 so that it is rotated about the pivot portion 10*a* in the counterclockwise direction in FIG. 4. The overrunning clutch 7 is pushed by the rotation of this shift lever 10. The overrunning clutch 7 and the pinion 8 are moved forward in one piece along the starter output shaft 6 (in the right direction in FIG. 4) so that the pinion 8 is engaged with the ring gear 14.

At this time, the rotational torque outputted from the armature 13 is transmitted from the sun gear 15 of the motor output shaft 4 to the planetary gears 16. Then, the planetary gears 16 are rotated between the sun gear 15 and the inner circumferential gear portion 18 while rotating about the pins 21; that is, the planetary gears 16 revolve around the sun gear 15 while rotating on their axes. The flange portion 20 that supports the planetary gears 16 rotates at a more reduced speed than the rpm of the motor output shaft 4 by the revolution of the planetary gears 16 and transmits the reduction speed rotational output to the starter output shaft 6. Then, the starter output shaft 6 rotates the ring gear 14 (crankshaft) at a reduced rpm through the overrunning clutch 7 and the pinion 8.

In such an electric starter motor, there are some cases where the crankshaft during the driving rotation is coupled with the starter output shaft 6 so that the crankshaft is abruptly stopped or where the starter output shaft 6 during the driving rotation is abruptly coupled with the crankshaft. In such a case, the excessive rotational torque would be abruptly applied to the starter output shaft 6. Then, after the rotational torque applied to the starter output shaft 6 has been transmitted from the flange portion 20 at one end of the starter output shaft 6 to the planetary gears 16, it is transmitted through the inner circumferential gear portion 18 to the internal gear 17 and at the same time transmitted through the sun gear 15 to the motor output shaft 4.

In the conventional electric starter motor, since the internal gear 17 and the front bracket 1 are coupled together by the rotation stop 19, there is a disadvantage that the shock stress caused by the excessive rotational torque abruptly changed on the loaded side is transmitted through the planetary reduction assembly 5 to the front bracket 1 and the motor output shaft 4 so that a fragile portion of each element in the output transmission system within the electric starter motor would be damaged.

SUMMARY OF THE INVENTION

In order to overcome the above-noted defects, an object of the present invention is to provide an electric starter motor that may absorb a shock stress caused by an excessive rotational torque in accordance with an abrupt change in load on an engine side and prevents a damage of elements of an output transmission system.

In order to achieve the above object, according to one aspect of the invention, there is provided an electric starter motor comprising:

a starter motor in which an armature is received in a yoke;

a planetary reduction assembly for transmitting a rotational output of the starter motor to a starter output shaft in a speed reduction manner;

an overrunning clutch mounted on the starter output shaft so as to restrict movement thereof in a circumferential direction and permit movement thereof in an axial direction;

a pinion disposed the starter output shaft together with the overrunning clutch so as to be able to slide freely in the axial direction; and an electromagnetic switch for controlling an electric supply to the starter motor and pushing the pinion towards a ring gear side of an engine together with the overrunning clutch through a shift lever, wherein the planetary reduction assembly comprises:

a sun gear engraved in an outer circumferential portion on a front side of a motor output shaft formed integrally with the armature;

a ring formed into a cylindrical shape with a rotation stop projecting on an outer circumferential wall surface thereof and fixed to a front bracket while its movement in the circumferential direction is restricted by the rotation stop;

an internal gear formed into a bottomed cylindrical shape with a center hole formed in a central portion of a bottom thereof and an inner circumferential gear portion engraved in an inner circumferential wall surface thereof, the internal gear being fitted in the ring so as to open on a rear side;

a discoid flange portion formed integrally with an end portion on the rear side of the starter output shaft, supported rotatably to the bottom of the internal gear through a bearing and rotatably supporting an end portion on the front side of the motor output shaft through a bearing; and a plurality of planetary gears rotatably supported to a plurality of pins implanted concentrically at an equiangular pitch on an end face on the rear side of the flange portion, respectively, and engaging with the inner circumferential gear portion and the sun gear, and wherein the internal gear is fitted in the ring so as to slidingly rotate relative to the ring when a rotational torque to be applied to the starter output shaft exceeds a predetermined transmission rotational torque.

DETAILED DESCRIPTION OF THE PREFERRED EMBODIMENTS

Embodiments of this invention will now be described with reference to the drawings.

Embodiment 1

Figure 1:
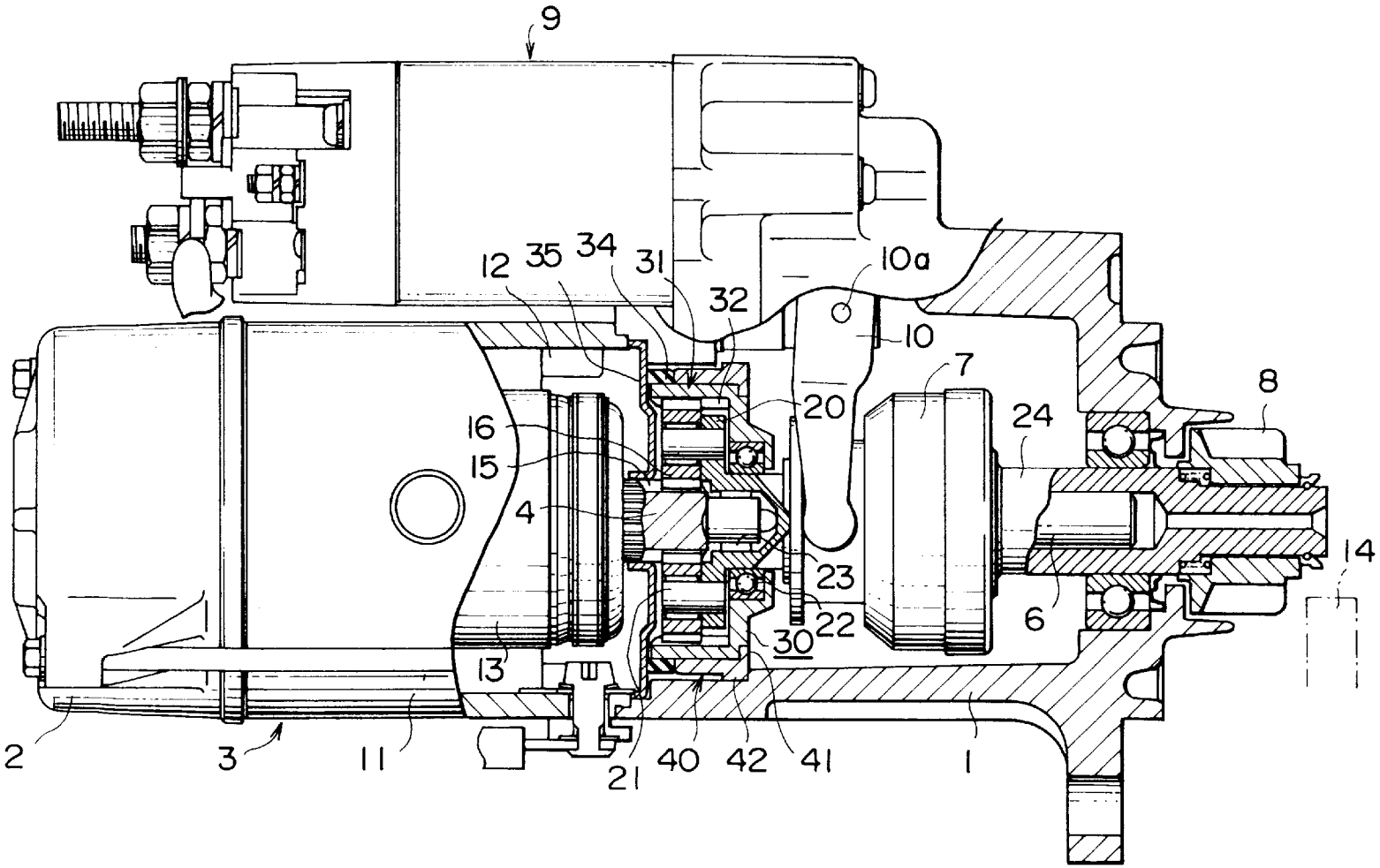
FIG. 1 is a partial cross-sectional view showing an electric starter motor incorporating a planetary reduction assembly in accordance with Embodiment 1 of this invention.
Figure 2:
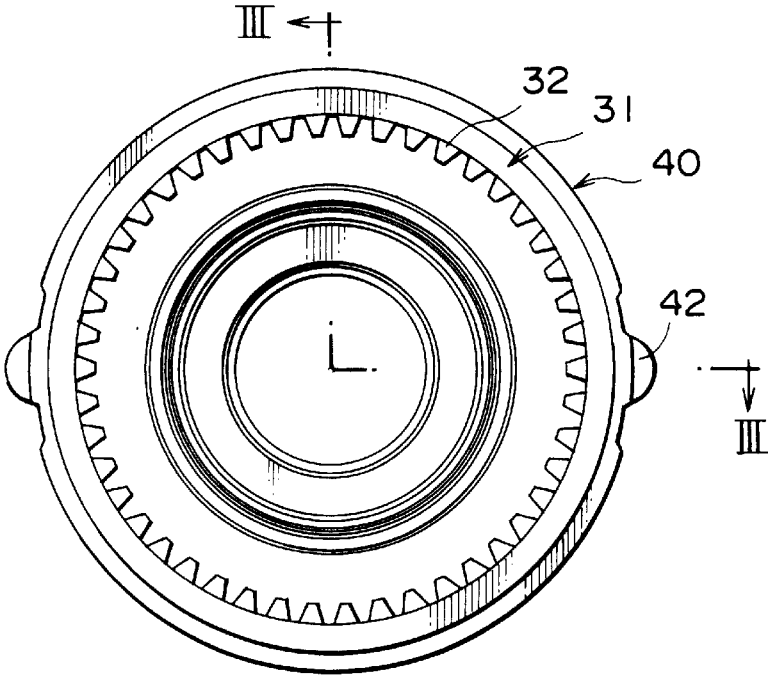
FIG. 2 is a frontal view of a primary part showing a coupled condition between an internal gear and a ring of the planetary reduction assembly in the electric starter motor in accordance with Embodiment 1 of the present invention.

FIG. 1 is a partial cross-sectional view showing an electric starter motor incorporating a planetary reduction assembly in accordance with Embodiment 1 of this invention; FIG. 2 is a frontal view of a primary part showing a coupled condition between an internal gear and a ring of the planetary reduction assembly in the electric starter motor in accordance with Embodiment 1 of the present invention; an FIG. 3 is a cross-sectional view taken along the line III—III of FIG. 2.

Figure 3:
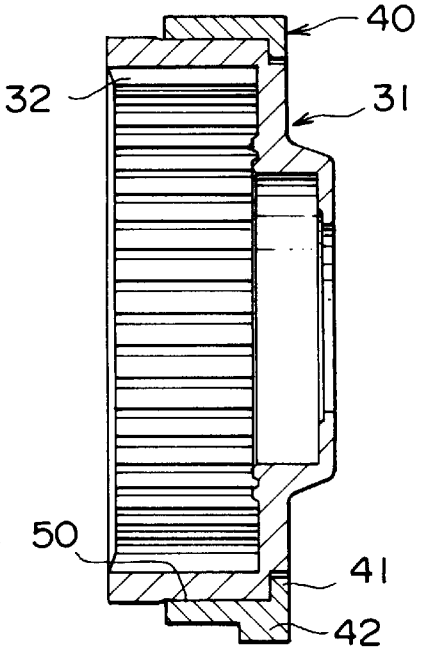
FIG. 3 is a cross-sectional view taken along the line III—III of FIG. 2.
Figure 4:
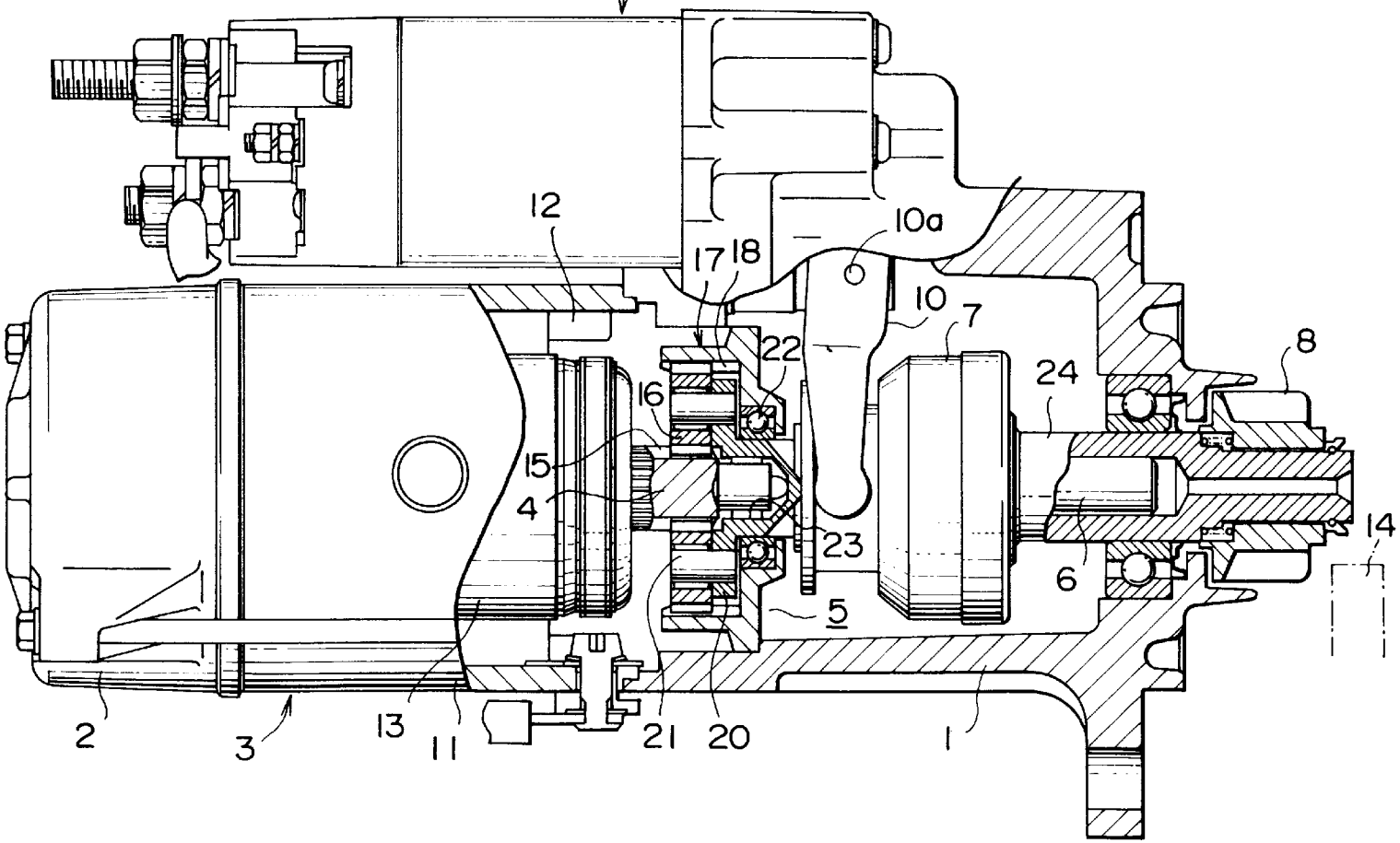
FIG. 4 PRIOR ART
FIG. 4 is a partial cross-sectional view showing a conventional electric starter motor incorporating a planetary speed reduction device.
Figure 5:
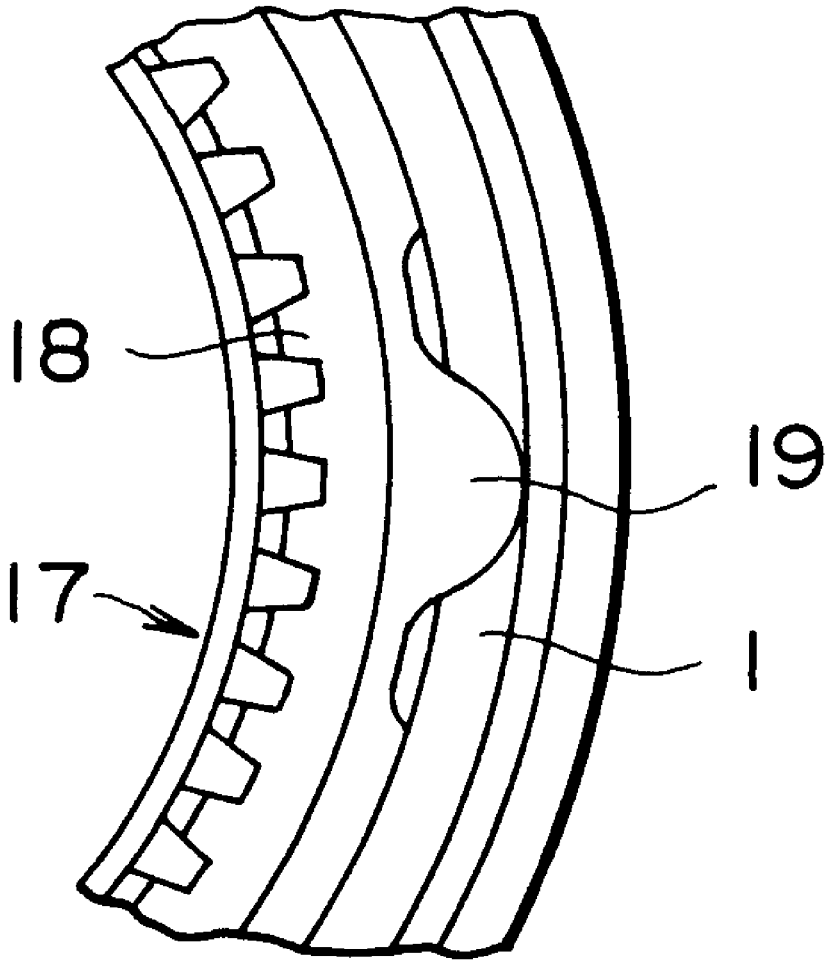
FIG. 5 PRIOR ART
FIG. 5 is a frontal view showing a primary part showing a coupled condition of an internal gear of the planetary reduction assembly in the conventional electric starter motor.

In FIGS. 1 to 3 the electric starter motor is composed of a starter motor 3 for generating a rotational torque, a planetary reduction assembly 30 for reducing and outputting an rpm of a motor output shaft 4 of this starter motor 3, a ring 40 for coupling this planetary reduction assembly 30 with a front bracket 1, an overrunning clutch 7 mounted on a starter output shaft 6 of the planetary reduction assembly 30 so as to be able to restrict its movement in the circumferential direction and move in the axial direction, a pinion 8 integrated with the overrunning clutch 7 and slidably disposed on the starter output shaft 6, an electromagnetic switch 9 for controlling an electric supply to the starter motor 3 and for pushing the pinion 8 together with the overrunning clutch 7 towards a ring gear 14 of an engine by means of a shift lever 10, and the like.

The starter motor 3 is composed of a yoke 11 formed into a cylindrical shape having a bottom portion also functioning as an outer frame and a magnetic circuit, a field coil 12 wound around this yoke 11, an armature 13 disposed within this field coil 12, a rectifier (not shown) mounted on the motor output shaft 4, which is a rotary shaft of the armature 13, a brush (not shown) disposed in sliding contact with this rectifier, and the like. Then, a rear bracket 2 is fitted around an outer circumference of a rear end of the yoke 11 and joined to the yoke 11 to thereby support the rear end of the motor rotary shaft 4. Also, the front bracket 1 is fitted around an outer circumference of a front end of the yoke 11 and joined to the yoke 11.

The ring 40 is made of steel material such as SCM415 and is formed into a cylindrical shape. A flange portion 41 is formed to project inwardly from one end of the cylindrical shape and a rotation stop 42 is formed to project outwardly from an outer circumferential wall surface thereof. Then, the ring 40 is fitted in the front bracket 1 so that its flange portion 41 is directed to the front side. At this time, the rotation stop 42 is engaged with the front bracket 1 so that the movement of the ring 40 in the circumferential direction is restricted.

The planetary reduction assembly 30 is composed of a sun gear 15 formed around an outer circumference of a front end of the motor rotary shaft 4, a plurality of planetary gears 16 meshing with this sun gear 15, an internal gear 31 meshing with each of the planetary gears 16 and the ring 40 in which the internal gear 31 is fitted.

The internal gear 31 is made of, for example, ferric system sintered material and is formed into a bottomed cylindrical shape. A center hole is formed in a central portion of a bottom portion of the bottomed cylindrical shape and an inner circumferential gear portion 32 is engraved in an inner circumferential wall surface thereof. Then, the internal gear 31 is fitted in the ring 40 so as to open on the rear side (on the side of the armature) by means of shrink fitting or press fitting. At this time, the end face of the internal gear 31 on the front side is brought into contact with the flange portion 41 so that the movement of the internal gear 31 in the axial direction is restricted.

A suitable allowance for fastening is provided at an engagement portion 50 between the ring 40 and the internal gear 31 so that the internal gear 31 may slide in the circumferential direction relative to the ring 40 in the engagement portion 50 when a rotational torque that is equal to or more than a predetermined torque is applied thereto. This predetermined torque (set transmission rotational torque) may be adjusted by the allowance for fastening the engagement portion 50 and is set up to be smaller than a value obtained by dividing a maximum transmission torque of the overrunning clutch 7 by a tooth ratio between the internal gear 31 and the sun gear 15 and to be greater than a value obtained by dividing the lock torque of the electric starter motor by the tooth ratio between the internal gear 31 and the sun gear 15.

Incidentally, the tooth ratio between the internal gear 31 and the sun gear 15 means a value obtained by dividing the tooth number of the inner circumferential gear portion 32 of the internal gear 31 by the tooth number of the sun gear 15.

A discoid flange portion 20 is formed integrally with a rear end of the starter output shaft 6. Then, a plurality of pins 21 are implanted concentrically at an equiangular pitch on the rear end surface of the flange portion 20. The planetary gears 16 are supported rotatably around the respective pins 21. This flange portion 20, i.e., the starter output shaft 6 is rotatably supported through a bearing 22 fitted in the center hole of the internal gear 31 fixed to the front bracket 1 so that the front end portion of the motor output shaft 4 is rotatably supported through a bearing 23 fitted in the flange portion 20. Thus, the plurality of planetary gears 16 mesh with the sun gear 15 and the inner circumferential gear portion 18 to thereby constitute a planetary speed reduction mechanism.

The sun gear 15 rotates together with the motor rotary shaft 4 to transmit the rotation of the motor rotary shaft 4 to each planetary gear 16. Then, each planetary gear 16 is subjected to the rotation of the sun gear 15 to revolve around the outer circumference of the sun gear 15 while rotating on its axis. The starter output shaft 6 is drivingly rotated by the revolution of the planetary gears 16.

The overrunning clutch 7 is mounted on the starter output shaft 6 so as to be able to move in the axial direction and such that the rotational motion is transmitted thereto. That is, the overrunning clutch 7 is spline-fitted onto the starter output shaft 6. The pinion 8 is joined to a front end portion of a sleeve shaft 24 which constitutes the overrunning clutch 7. The shift lever 10 is mounted rotatably about a pivot portion 10*a* in its intermediate portion with its one end being engaged with the overrunning clutch 7 and the other end being coupled to a plunger (not shown) of the electromagnetic switch 9 mounted above the starter motor 3.

A packing 34 is formed into a ring and fitted on an end face of the internal gear 31 on the rear side (on a side of the yoke 11) to depress on the front side in the axial direction of the internal gear 31. Also, a plate 35 is interposed between the end face of the packing 34 and the end face of the yoke 11 for preventing the pull-off of the planetary gears 16 and for sealing lubricant oil.

In such an electric starter motor, since the above-described predetermined transmission rotational torque is set up to be smaller than the value obtained by dividing the maximum transmission torque of the overrunning clutch 7 by the tooth ratio between the internal gear 31 and the sun gear 15 and to be greater than a value obtained by dividing the lock torque of the electric starter motor by the tooth ratio between the internal gear 31 and the sun gear 15, under the normal condition, the rotational operation and the speed reduction operation are performed in the same manner as in the conventional starter motor assembly.

In this case, when the drivingly rotated crankshaft is abruptly coupled with the starter output shaft 6 so that the crankshaft is abruptly stopped or the drivingly rotated starter output shaft 6 is abruptly coupled with the crankshaft, an excessive rotational torque is abruptly applied to the starter output shaft 6. Then, after the excessive rotational torque applied to the starter output shaft 6 has been transmitted from the flange portion 20 at one end of the starter output shaft 6 to the planetary gears 16, it is transmitted through the inner circumferential gear portion 32 to the internal gear 31, further transmitted through the ring 40 to the front bracket 1 and at the same time transmitted to the motor output shaft 4 through the sun gear 15.

Then, when the rotational torque that has been applied to the starter output shaft 6 exceeds the predetermined transmission rotational torque, the internal gear 31 is slidingly rotated relative to the ring 40 at the engagement portion 50 so that the excessive rotational torque is neither transmitted through the ring 40 to the front bracket 1 nor through the sun gear 15 to the motor output shaft 4.

Thus, in accordance with this embodiment, when a rotational torque that exceeds the predetermined transmission rotational torque is applied to the starter output shaft 6, since the internal gear 31 is so constructed to be slidingly rotated relative to the ring 40 at the engagement portion 50, even if the load on the engine side is abruptly increased so that the excessive rotational torque is applied to the starter output shaft 6, the excessive rotational torque is absorbed by the engagement portion 50 and would not be transmitted to the front bracket 1 or the motor output shaft 4. Accordingly, the damage of the elements of the output transmission system within the electric starter motor caused by the load change on the engine side may be prevented in advance.

Also, since the above-described predetermined transmission rotational torque is set up to be greater than the value obtained by dividing the lock torque of the electric starter motor by the tooth ratio between the internal gear 31 and the sun gear 15, the regular rotational operation and the speed reduction operation may be performed. The engine may be started without any problem. Namely, since the rotational torque enough to start the engine is transmitted from the motor output shaft 4 to the ring gear 14 through the planetary reduction assembly 30 and the overrunning clutch 7, the engine is started and the characteristics of the electric starter motor may be positively ensured. Also, since the above-described predetermined transmission rotational torque is set up to be smaller than the value obtained by dividing the maximum transmission torque of the overrunning clutch 7 by the tooth ratio between the internal gear 31 and the sun gear 15, when the load on the engine side is abruptly increased so that the excessive rotational torque is applied to the starter output shaft 6, the internal gear 31 is slidingly rotated relative to the ring 40 so that the transmission of the excessive rotational torque to the front bracket 1 or the motor output shaft 4 is prevented and the damage of the elements of the output transmission system within the electric starter motor caused by the load change on the engine side may be prevented in advance.

Furthermore, since the flange portion 41 projects inwardly from one end of the ring 40, the front side end face of the internal gear 31 is brought into contact with the flange portion 41 so that the movement of the internal gear 31 in the axial direction on the front side is restricted. Accordingly, the movement of the planetary reduction assembly 30 in the axial direction is restricted so that the rattle of the planetary reduction assembly 30 in the axial direction is suppressed and the operation of the planetary reduction assembly 30 for transmitting the rotational torque of the motor output shaft 4 in a speed reduction manner to the start output shaft 6 may be performed stably.

Embodiment 2

In the above-described Embodiment 1, the internal gear 31 is made of ferric system sintered material and the ring 40 is made of steel material (for example, SCM415). However, in Embodiment 2, the lubricant (for example, lubricant oil) is impregnated into the internal gear 31 made of the ferric system sintered material, and a surface curing process is applied to the ring 40 made of steel material. In this case, the surface curing process is, for example, a surface improving process such as a liquid nitriding process or a plating process with CrP, NiP or the like.

Incidentally, the other structure is the same as that of Embodiment 1.

In the above-described Embodiment 1, since the internal gear 31 is made of a ferric system sintered material and the ring 40 is made of steel material (for example, SCM415), the hardness of the internal gear 31 is higher than the hardness of the ring 40. Therefore, when the sliding rotational operation of the internal gear 31 relative to the ring 40 at the engagement portion 50 is repeatedly performed, the heat sticking between the internal gear 31 and the ring 40 is likely to occur, and there is a fear that the sliding rotational operation of the internal gear 31 relative to the ring 40 would not be performed smoothly.

However, in Embodiment 2, since the surface curing process is applied to the inner circumferential wall surface of the ring 40, the surface hardness of the ring 40 at the engagement portion 50 is enhanced. Even if the internal gear 31 is slidingly rotated relative to the ring 40, the generation of the heat sticking between the internal gear 31 and the ring 40 is prevented. Therefore, even if the sliding rotational operation of the internal gear 31 relative to the ring 40 at the engagement portion 50 caused by the load change on the engine side is repeatedly performed, there is no fear that the surfaces of the internal gear 31 and the ring 40 which are in intimate contact with each other at the engagement portion 50 are roughened. The smooth rotational operation of the internal gear 31 is performed to enhance the reliability of the starter motor assembly.

Furthermore, since the internal gear 31 is impregnated with the lubricant, the lubricant is always interposed between the intimate surfaces of the internal gear 31 and the ring 40 so that the generation of the heat sticking between the internal gear 31 and the ring 40 is prevented without fail to thereby further enhance the reliability of the starter motor assembly. Also, since the lubricant is impregnated into the internal gear 31, the replenishment of the lubricant is unnecessary and it is possible to provide the electric starter motor that may operate stably for a long time.

Incidentally, in the above-described Embodiment 2, the surface curing process is applied to the ring 40. However, the surface curing process is not always applied to the whole ring 40. It is sufficient to apply the surface of the ring 40 that is in intimate contact with the internal gear 31.

Also, in the above-described Embodiment 2, the lubricant is impregnated into the internal gear 31. However, the lubricant is not always impregnated into the internal gear 31. It is sufficient to apply the lubricant between the intimate surfaces of the internal gear 31 and the ring 40.

The present invention is thus structured and the following advantages may be enjoyed.

According to this invention, it is possible to provide an electric starter motor comprising:

a starter motor in which an armature is received in a yoke;

a planetary reduction assembly for transmitting a rotational output of the starter motor to a starter output shaft in a speed reduction manner;

an overrunning clutch mounted on the starter output shaft so as to restrict movement thereof in a circumferential direction and permit movement thereof in an axial direction;

a pinion disposed the starter output shaft together with the overrunning clutch so as to be able to slide freely in the axial direction; and an electromagnetic switch for controlling an electric supply to the starter motor and pushing the pinion towards a ring gear side of an engine together with the overrunning clutch through a shift lever, wherein the planetary reduction assembly comprises:

a sun gear engraved in an outer circumferential portion on a front side of a motor output shaft formed integrally with the armature;

a ring formed into a cylindrical shape with a rotation stop projecting on an outer circumferential wall surface thereof and fixed to a front bracket while its movement in the circumferential direction is restricted by the rotation stop;

an internal gear formed into a bottomed cylindrical shape with a center hole formed in a central portion of a bottom thereof and an inner circumferential gear portion engraved in an inner circumferential wall surface thereof, the internal gear being fitted in the ring so as to open on a rear side;

a discoid flange portion formed integrally with an end portion on the rear side of the starter output shaft, supported rotatably to the bottom of the internal gear through a bearing and rotatably supporting an end portion on the front side of the motor output shaft through a bearing; and a plurality of planetary gears rotatably supported to a plurality of pins implanted concentrically at an equiangular pitch on an end face on the rear side of the flange portion, respectively, and engaging with the inner circumferential gear portion and the sun gear, and wherein the internal gear is fitted in the ring so as to slidingly rotate relative to the ring when a rotational torque to be applied to the starter output shaft exceeds a predetermined transmission rotational torque. Accordingly, even if the excessive rotational torque that exceeds the predetermined transmission rotational torque caused by the abrupt load change on the engine side is applied to the starter output shaft, the internal gear slidingly rotates relative to the ring to thereby absorb the shock stress caused by the excessive rotational torque to provide an electric starter motor that may prevent the damage of the elements of the output transmission system.

Also, the predetermined transmission rotational torque may be set up to be smaller than a value obtained by dividing a maximum transmission torque of said overrunning clutch by a tooth ratio between said internal gear and said sun gear (the number of teeth of the inner circumferential gear portion/the number of teeth of the sun gear) and to be greater than a value obtained by dividing a lock torque of said electric starter motor by the tooth ratio between said internal gear and said sun gear (the number of teeth of the inner circumferential gear portion/the number of teeth of the sun gear). Accordingly, the regular rotational operation and speed reduction operation may be performed without any problem and the engine may be started without fail.

Further, the surface curing process may be applied to the surface of the ring that is in intimate contact with the internal gear and the lubricant is interposed between the intimate contact surfaces of the ring and the internal gear. Therefore, the heat sticking between the internal gear and the ring caused by the sliding rotation of the internal gear to the ring is prevented to thereby enhance the reliability of the starter motor assembly.

Furthermore, the internal gear may be made of sintered material and the lubricant is impregnated into the internal gear. Therefore, the lubricant is always interposed between the internal gear and the ring to thereby further enhance the reliability of the starter motor assembly.

Furthermore, the flange portion may be projected inwardly from the end portion of the ring on the front side. Therefore, the axial movement of the internal gear is restricted and it is possible to perform the rotational operation and speed reduction operation of the planetary reduction assembly without fail.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An electric starter motor comprising:

a starter motor in which an armature is received in a yoke;

a planetary reduction assembly for transmitting a rotational output of said starter motor to a starter output shaft in a speed reduction manner;

an overrunning clutch mounted on said starter output shaft so as to restrict movement thereof in a circumferential direction and permit movement thereof in an axial direction;

a pinion disposed on said starter output shaft together with said overrunning clutch so as to operably slide freely in the axial direction; and an electromagnetic switch for controlling an electric supply to said starter motor and, through a shift lever, pushing said pinion towards a ring gear side of an engine together with said overrunning clutch, wherein said planetary reduction assembly comprises:

a sun gear engraved in an outer circumferential portion on a front side of a motor output shaft formed integrally with said armature;

a ring formed into a cylindrical shape with a rotation stop projecting from an outer circumferential wall surface thereof, said ring being coupled to a front bracket while its movement in the circumferential direction is restricted by the rotation stop;

an internal gear formed into a bottomed cylindrical shape with a center hole formed in a central portion of a bottom thereof and an inner circumferential gear portion engraved in an inner circumferential wall surface thereof, said internal gear being fitted in said ring so as to open on a rear side;

a discoid flange portion formed integrally with an end portion on the rear side of said starter output shaft, supported rotatably to the bottom of the internal gear through a bearing and rotatably supporting an end portion on the front side of said motor output shaft through a bearing; and a plurality of planetary gears rotatably supported to a plurality of pins implanted concentrically at an equiangular pitch on an end face on the rear side of said flange portion, respectively, and engaging with said inner circumferential gear portion and said sun gear, and wherein said internal gear is fitted in said ring so as to slidingly rotate relative to said ring when a rotational torque is applied to said starter output shaft which exceeds a predetermined transmission rotational torque.

2. The electric starter motor according to claim 1, wherein a surface curing process is applied to a surface of said ring that is in intimate contact with said internal gear and a lubricant is interposed between the intimate contact surfaces of said ring and said internal gear.

3. The electric starter motor according to claim 2, wherein said internal gear is made of sintered material and the lubricant is impregnated into said internal gear.

4. The electric starter motor according to claim 1, wherein the predetermined transmission rotational torque is set up to be smaller than a value obtained by dividing a maximum transmission torque of said overrunning clutch by a tooth ratio between said internal gear and said sun gear (the number of teeth of the inner circumferential gear portion/the number of teeth of the sun gear) and to be greater than a value obtained by dividing a lock torque of said electric starter motor by the tooth ratio between said internal gear and said sun gear (the number of teeth of the inner circumferential gear portion/the number of teeth of the sun gear).

5. The electric starter motor according to claim 4, wherein a surface curing process is applied to a surface of said ring that is in intimate contact with said internal gear and a lubricant is interposed between the intimate contact surfaces of said ring and said internal gear.

6. The electric starter motor according to claim 5, wherein said internal gear is made of sintered material and the lubricant is impregnated into said internal gear.

7. The electric starter motor according to claim 1, further comprising a flange portion projected inwardly from an end portion of said ring on the front side.

* * * * *